US005974982A

United States Patent [19]

Lepper et al.

[11] Patent Number: 5,974,982

[45] Date of Patent: Nov. 2, 1999

[54] FITTING FOR FOLDING TABLE

[75] Inventors: Christain Lepper; Roland Schmidt; Uwe Sommerlade, all of Kassel, Germany

[73] Assignee: Kusch + Co Sitzmoebelwerke GmbH & Co. KG, Hallenberg, Germany

[21] Appl. No.: 09/187,271

[22] Filed: Nov. 6, 1998

[51] Int. Cl.[6] ..... A47B 3/00

[52] U.S. Cl. ..... 108/132; 108/131

[58] Field of Search ..... 108/132, 131, 108/91, 129, 115; 248/188.6

[56] References Cited

U.S. PATENT DOCUMENTS

| | | | |
|---|---|---|---|
| 963,439 | 7/1910 | Hastings | 108/132 |
| 1,138,156 | 5/1915 | Stroud | 108/131 X |
| 1,923,281 | 8/1933 | Smith | 108/131 |
| 1,969,723 | 8/1934 | Bontemps | 108/131 |
| 2,003,241 | 5/1935 | Brown | 108/131 X |
| 3,604,372 | 9/1971 | Hewett | 108/91 X |
| 4,841,877 | 6/1989 | Virtue | 108/91 X |

FOREIGN PATENT DOCUMENTS

| | | | |
|---|---|---|---|
| 595851 | 10/1925 | France | 108/132 |
| 3011270 | 10/1981 | Germany . | |
| 3436358 | 4/1986 | Germany . | |

*Primary Examiner*—Jose V. Chen
*Attorney, Agent, or Firm*—Friedrich Kueffner

[57] ABSTRACT

A fitting for a table leg of a folding table which can be folded in when the table is not in use, wherein the table leg is pivotally mounted in a bearing component attached underneath the table plate. In the position of use of the table, the table leg can be locked. A drop lever is pivotally mounted in the bearing component. When the table leg is folded out into the position of use of the table, the drop lever automatically as a result of gravity locks the table leg against a stop serving as an abutment and automatically unlocks the table leg when the table is placed in a stacking position.

3 Claims, 8 Drawing Sheets

Fig. 3
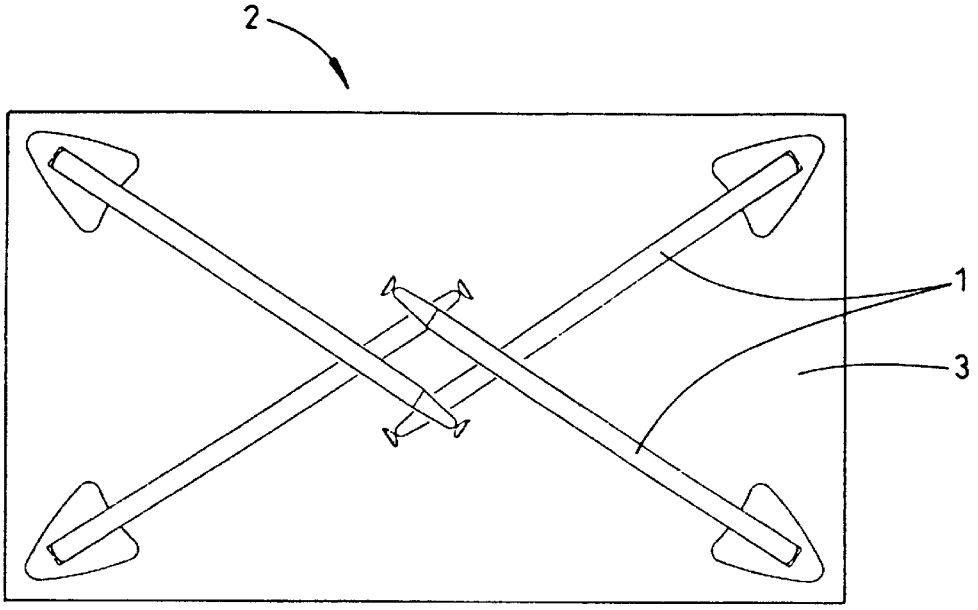
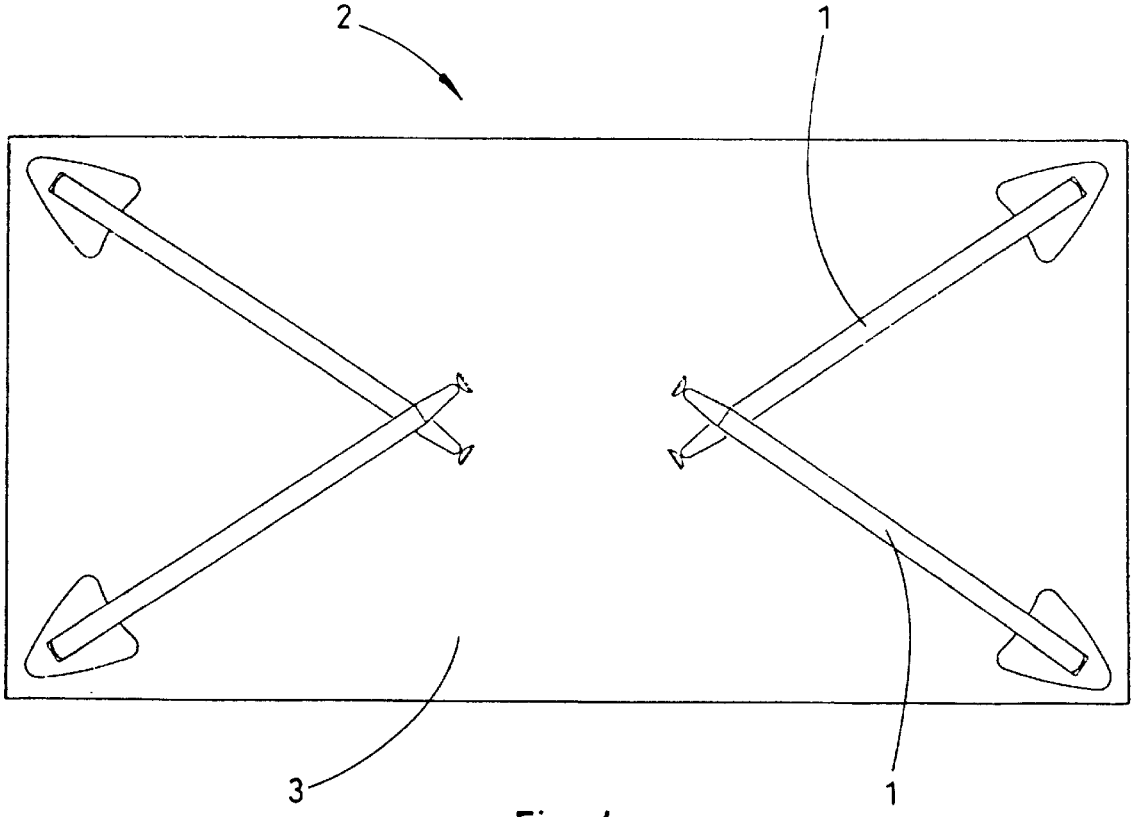
Fig. 4

Fig. 5
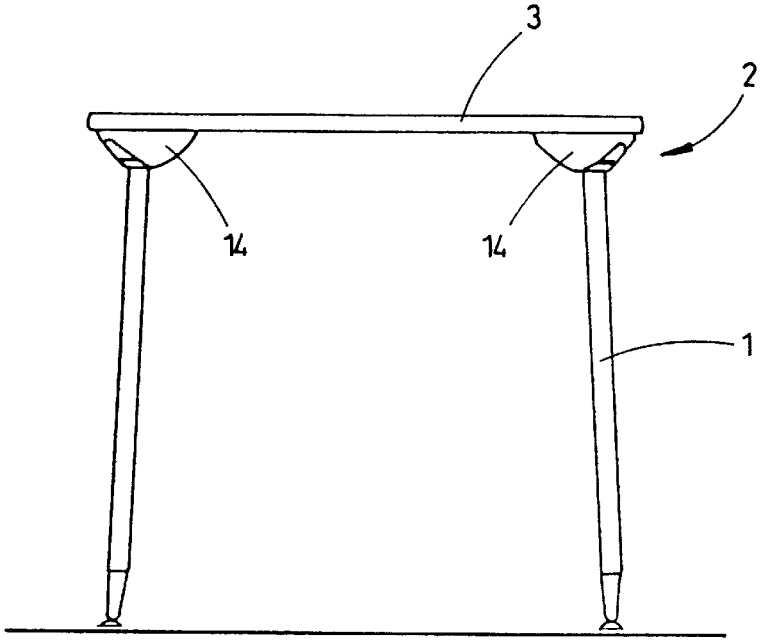
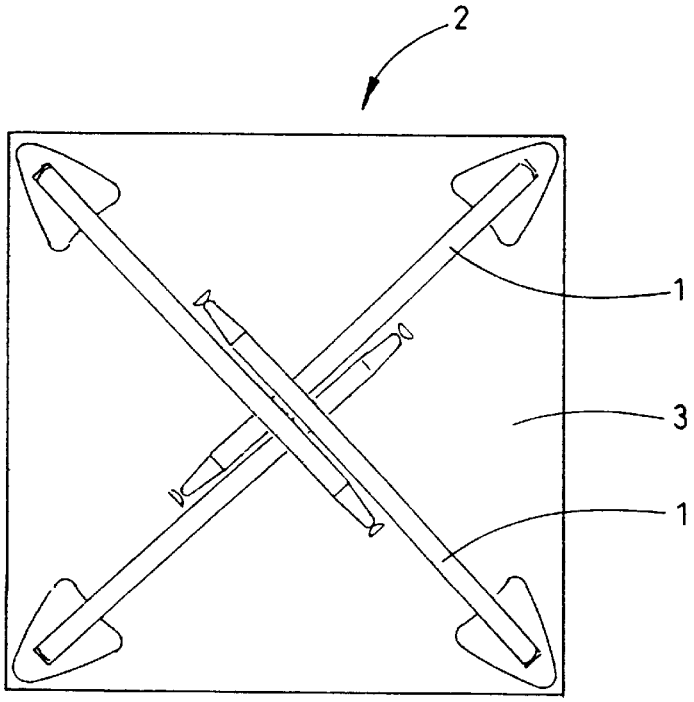
Fig. 6

Fig. 11
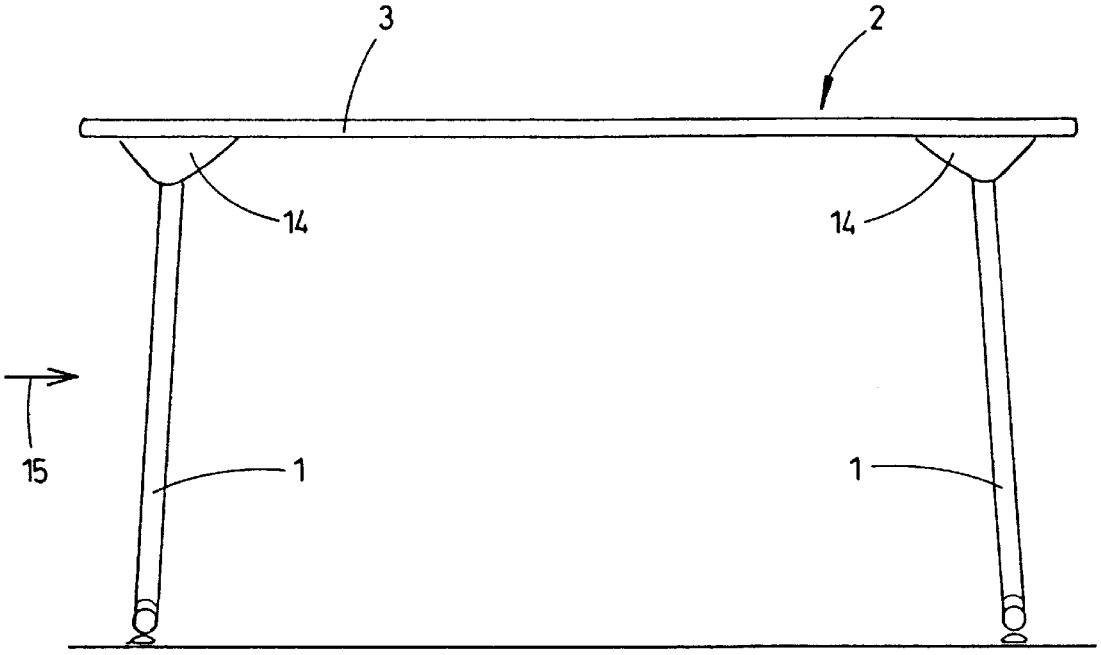
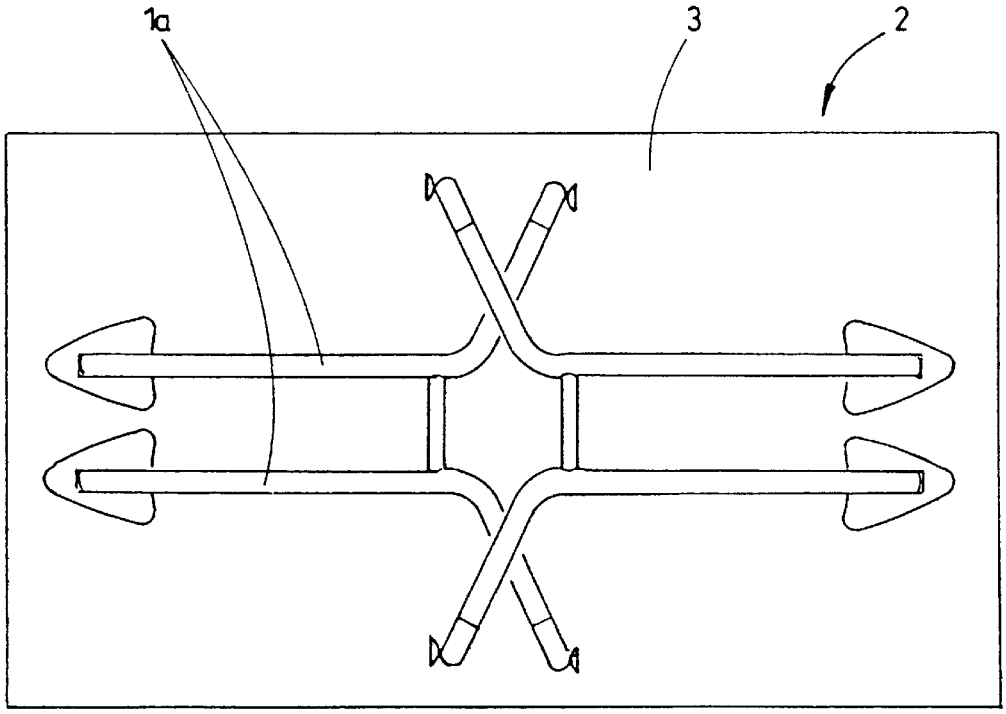
Fig. 12

Fig. 13
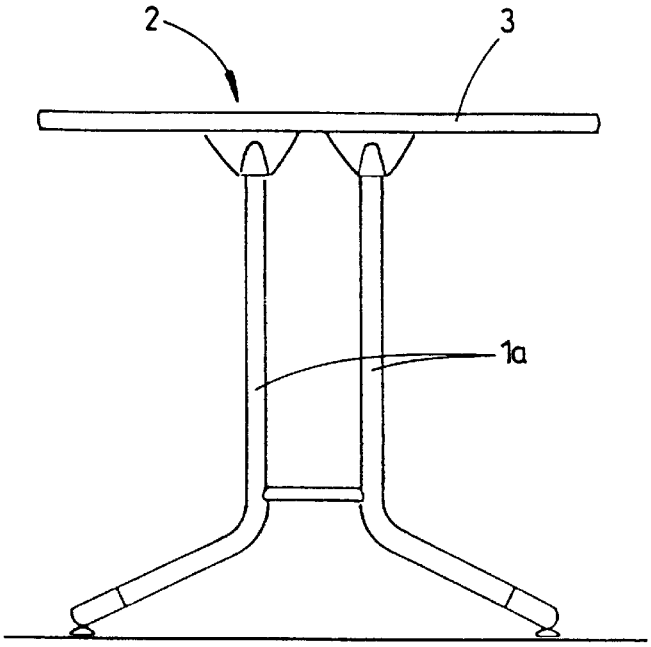
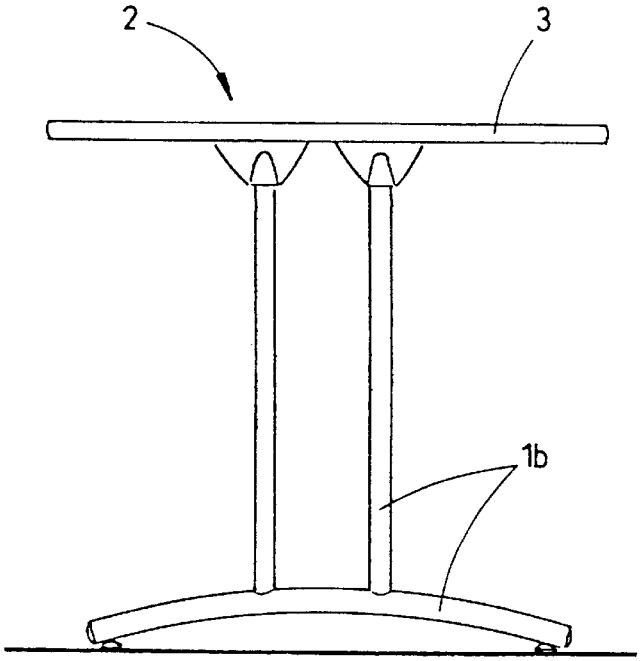
Fig. 14

FITTING FOR FOLDING TABLE

BACKGROUND OF THE INVENTION

1. Field of the Invention

The present invention relates to a fitting for a folding table.

2. Description of the Related Art

Fittings for table legs which can be folded in when the table is not in use are known in the art. The table leg is pivotally mounted in a bearing component attached underneath the table plate. In the position of use of the table, the table leg can be locked.

SUMMARY OF THE INVENTION

It is the primary object of the present invention to provide a structurally very simple fitting for a folding table which permits an automatic locking and unlocking of the table leg and which, since a fitting is provided for each individual table leg, can be used for practically all types and shapes of folding tables.

In accordance with the present invention, a drop lever is pivotally mounted in the bearing component. When the table leg is folded out into the position of use of the table, the drop lever automatically as a result of gravity locks the table leg against a stop serving as an abutment and automatically unlocks the table leg when the table is placed in a stacking position.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

BRIEF DESCRIPTION OF THE DRAWING

In the drawing:

FIGS. 3 to 14 illustrate examples of applications for different shapes of tables.

DESCRIPTION OF THE PREFERRED EMBODIMENTS

Figure 1:
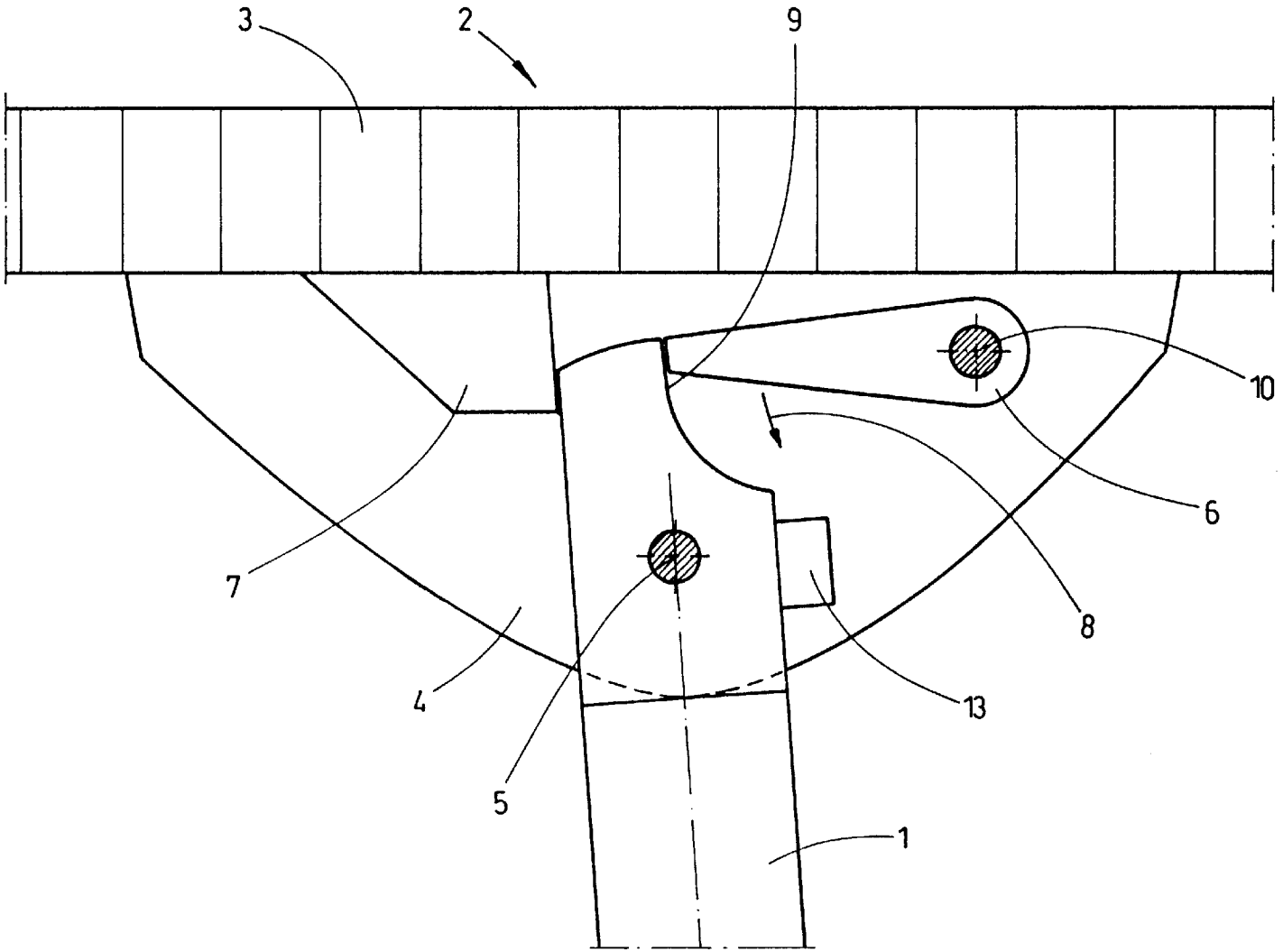
FIG. 1 is a side view, partially in section, of a fitting for a folding table in the position of use of the table.

FIG. 1 of the drawing shows the fitting according to the present invention for a table leg 1 in the position of use, i.e., with the table leg 1 being folded out from the table 2. Mounted underneath a table plate 3 of the table 2 is a bearing component 4 for each fitting, i.e., for each table leg 1. The bearing component 4 may be composed of a piece of sheet metal bent into a U-shape.

The table leg 1 is mounted in the bearing component 4 so as to be pivotable about an axis 5. In the position of use of the table 2 shown in FIG. 1, the end of the table leg 1 located within the bearing component 4 rests against a stop 7 serving as an abutment for a drop lever 6, while the drop lever 6, which automatically as a result of gravity pivots in the direction of the arrow 8 when the table leg 1 is folded out, locks the table leg 1 at an inclined surface 9 thereof.

The table leg 1 is slightly outwardly inclined, i.e., the table leg 1 forms on the side located opposite the drop lever 6 and the inclined surface 9 an angle of somewhat more than 90°0 with the table plate 3. The drop lever 6 is mounted so as to be pivotable about an axis 10.

Figure 2:
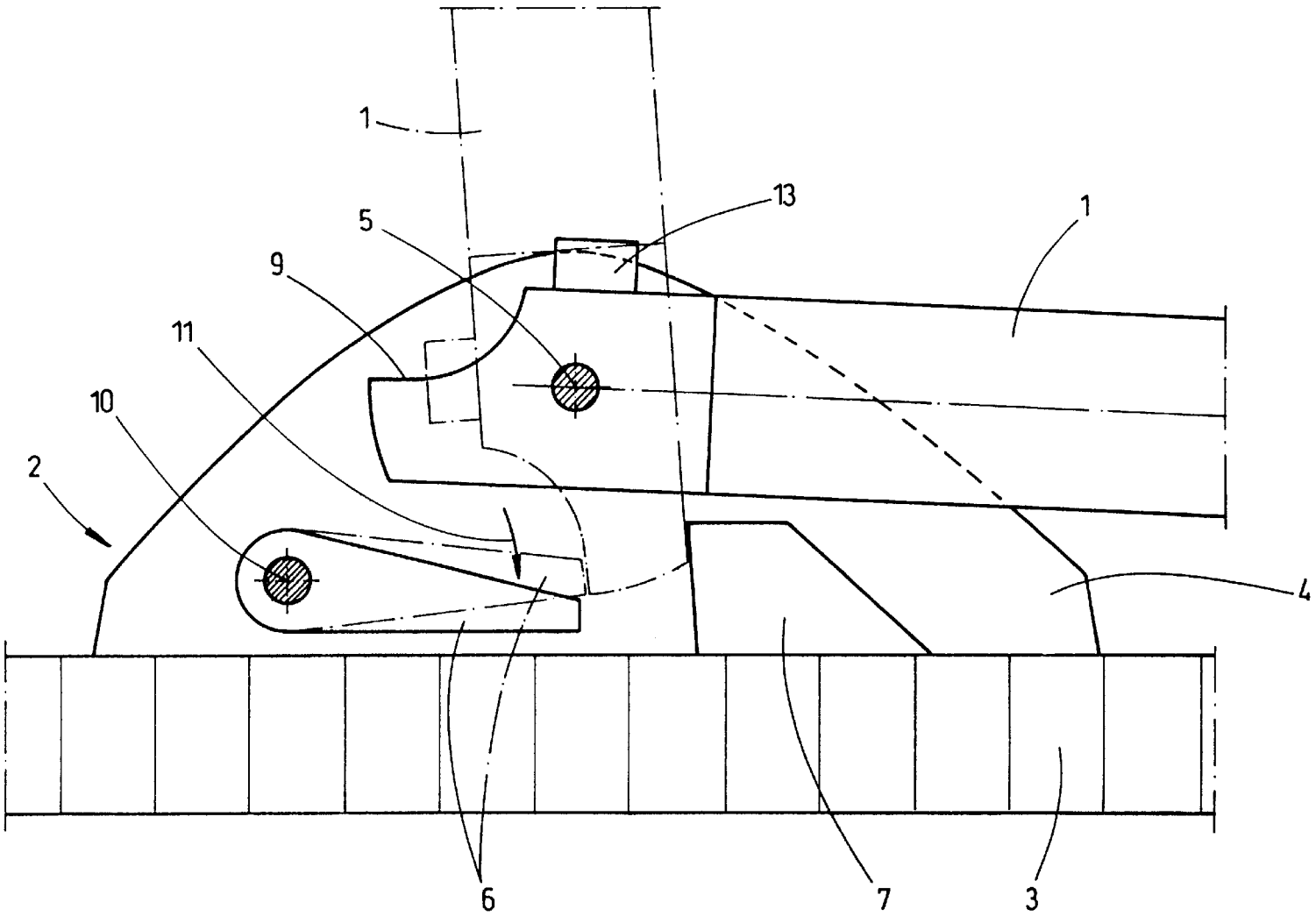
FIG. 2 is a side view, partially in section, of a fitting for a folding table in the stacking position of the table.

FIG. 2 of the drawing shows the stacking position of the table leg 1 in solid lines. For stacking the table 2 with tables of the same type, the table 2 is turned upside down with the table plate 3 facing down. This causes the drop lever 6 once again to pivot as a result of gravity in the direction of the arrow 11 into the unlocked position shown in solid lines. The locked position of table 1 and drop lever 6 is shown in broken lines in FIG. 2.

As can be seen in FIGS. 1 and 2, the stop 7 for the table leg 1 ensures that when the table 2 is turned upside down, the drop lever 6 does not disengage too early from the locking position with the table leg 1 which might lead to injuries.

For unlocking the table leg, it is sufficient to slightly press against the free end of the table leg 1 toward the outer edge of the table plate 3, so that the drop lever 6 pivots as a result of gravity from the locking position and the table leg 1 can be folded.

For avoiding damage to the table plate 3 of the next higher table 1 in the stack of tables, a stacking buffer or pad 13 is provided on each table leg 1, for example, in the vicinity of the inclined surface 9.

As already mentioned above, the fitting according to the present invention, which is the same for each table leg 1 and, therefore, can be manufactured inexpensively, is useable in all possible and conceivable shapes of tables. Some examples of applications are shown in FIGS. 3 to 14.

FIGS. 3 to 6 show rectangular or square shapes of the table plate 3, wherein the table legs 1 are shown folded in in FIGS. 3, 4 and 6. FIG. 5 shows the square table of FIG. 6 in the folded out state and shows that the fitting can be provided with a plastic cap 14 with a recess for enabling movement of the table leg 1, so that the entire mechanism of the fitting is cleanly covered.

Figure 7:
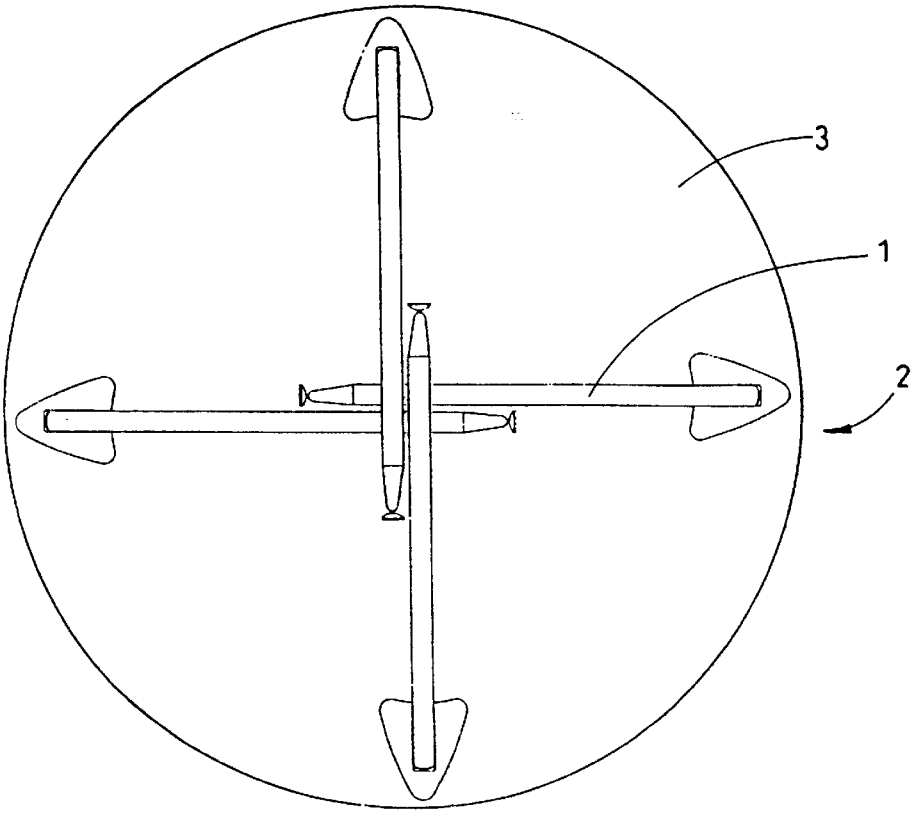
Figure 8:
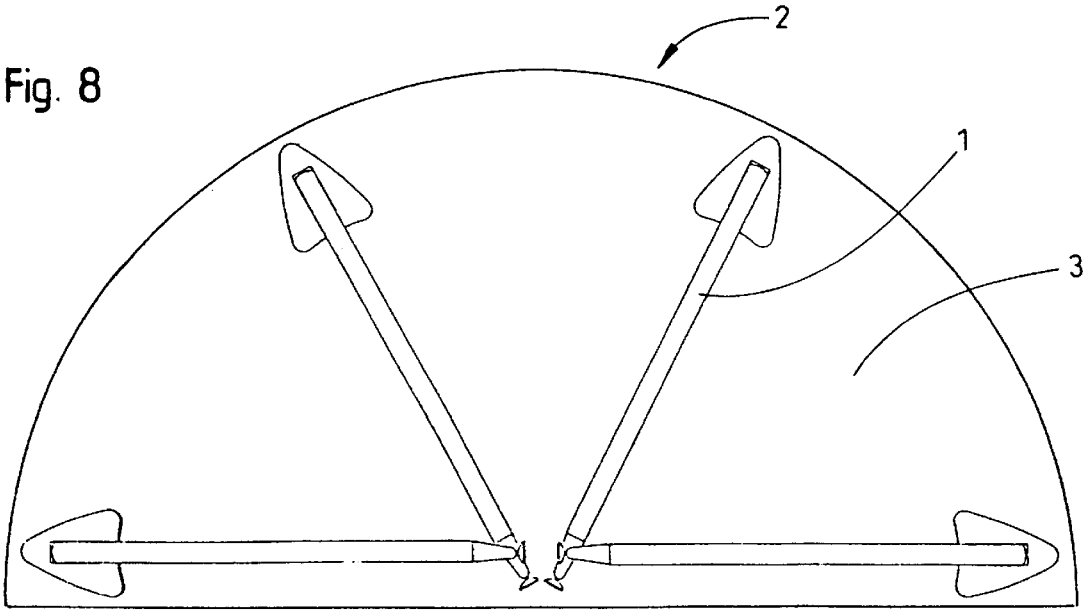

FIG. 7 shows folded-in table legs 1 of a table having a round table plate 3. FIG. 8 shows the arrangement on a table 2 having a semicircular table plate 3.

Figure 9:
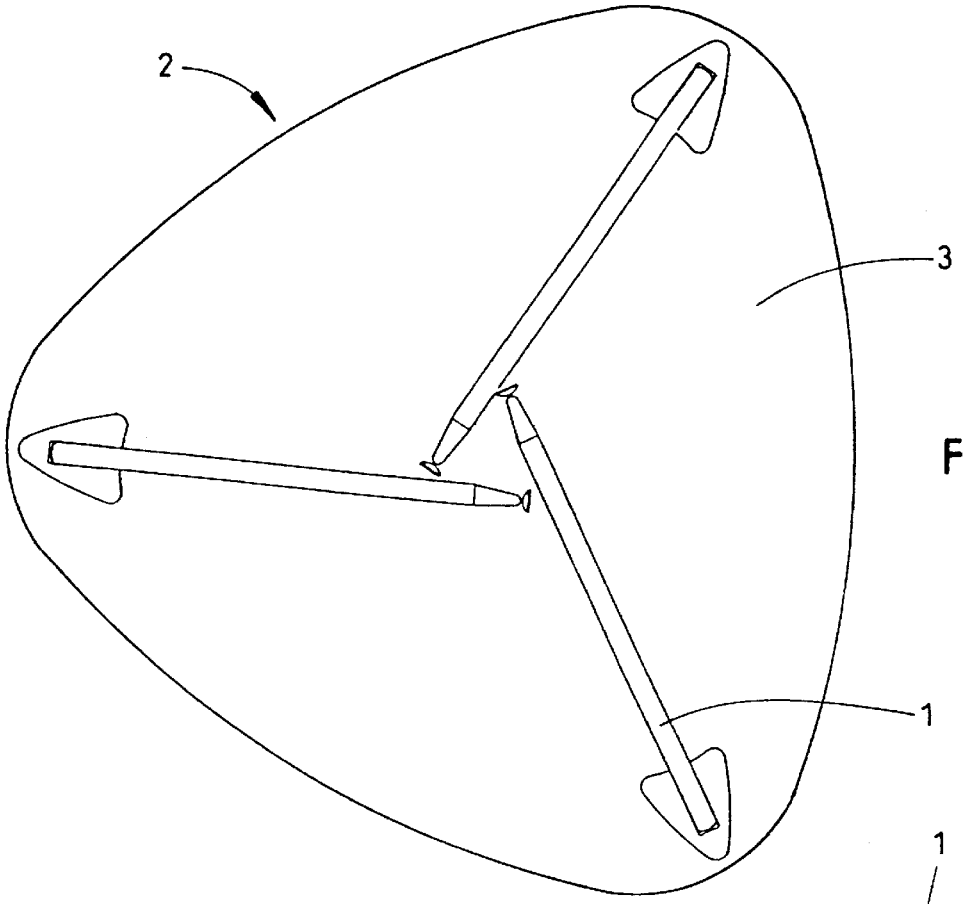
Figure 10:
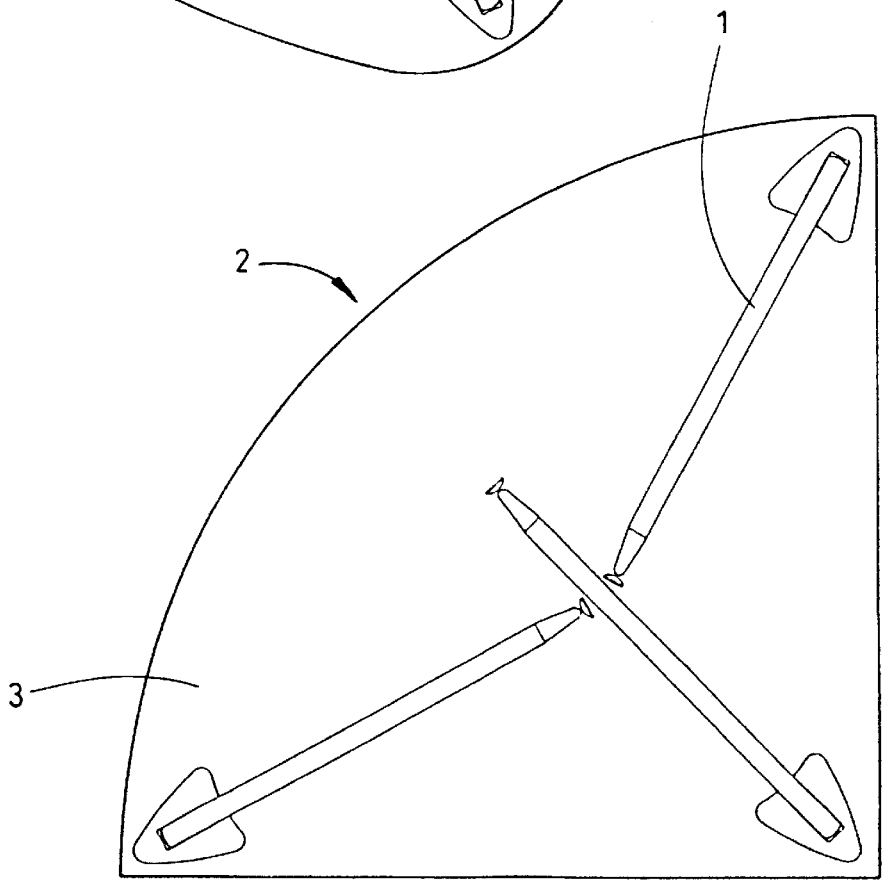

FIG. 9 shows the folded-in table legs 1 at a table plate 3 having a triangular, rounded-off shape and FIG. 10 shows a table plate 3 having the shape of a quarter circle.

FIG. 11 is a side view of a table 2 with folded out T-shaped table legs 1*a,* and FIG. 12 shows the T-shaped table legs 1*a* in the folded-in state. FIG. 13 is a side view in the direction of the arrow 15 in FIG. 11. FIG. 14 shows another embodiment of T-shaped table legs 1*b.* In the case of these T-shaped table legs 1*a* or 1*b,* the upper end of each portion of each T-shaped table leg 1*a,* 1*b* is also mounted in the fitting according to the present invention described above and shown in FIGS. 1 and 2.

While specific embodiments of the invention have been described in detail to illustrate the inventive principles, it will be understood that the invention may be embodied otherwise without departing from such principles.

We claim:

1. A fitting in combination with a table leg foldable between a position of use and a stacking position of the table, the table having a table plate, the fitting comprising a bearing component attached underneath the table plate, the table leg being mounted so as to be pivotable in the bearing component, further comprising a drop lever pivotally mounted in the bearing component, the bearing component having a stop serving as an abutment, wherein the drop lever is mounted such that the lever automatically as a result of gravity locks the table leg against the stop in the position of use of the table and automatically unlocks the table leg when the table is moved into the stacking position, wherein the table leg in the position of use of the table includes an angle of greater than 90° with the table plate on a side located opposite the drop lever, and wherein the table leg has an inclined surface facing the drop lever for engagement by the drop lever when the table leg is in the position of use.

2. The fitting according to claim 1, wherein the table leg comprises a stacking buffer.

3. The fitting according to claim 2, wherein the stacking buffer is mounted adjacent the inclined surface of the table leg.

* * * * *